US005816939A

United States Patent [19]

Hamada et al.

[11] Patent Number: 5,816,939

[45] Date of Patent: Oct. 6, 1998

[54] WOUND GOLF BALL AND RUBBER THREAD THEREFORE

[75] Inventors: Akihiko Hamada, Kakogawa; Atsuko Ochi, Nishiwaki; Michio Suzuki, Hyogo-ken, all of Japan

[73] Assignees: Sumitomo Rubber Industries, Ltd.; Sumitomo Seika Chemicals Co., Ltd., both of Hyogo-ken, Japan

[21] Appl. No.: 825,332

[22] Filed: Mar. 28, 1997

[30] Foreign Application Priority Data

Mar. 29, 1996 [JP] Japan ..... 8-076212

[51] Int. Cl.[6] ..... A63B 37/06

[52] U.S. Cl. ..... 473/357; 428/364

[58] Field of Search ..... 473/363, 357; 428/364

[56] References Cited

U.S. PATENT DOCUMENTS 5,338,038 8/1994 Cadorniga ..... 473/363 X

*Primary Examiner*—George J. Marlo

*Attorney, Agent, or Firm*—Birch, Stewart, Kolasch & Birch, LLP

[57] ABSTRACT

A thread rubber for golf balls, which has good aging resistance and rebound characteristics, and to a thread wound golf ball using the thread rubber are disclosed. The thread rubber for golf balls has a retention of tensile strength after aging 7 days at 70° C. of not less than 70%, a hysteresis loss at a 100 Kg/cm$^2$ constant stress tensile of not more than 50% and an elongation at a 100 Kg/cm$^2$ constant stress elongation within the range of 900 to 1400%.

6 Claims, 2 Drawing Sheets

WOUND GOLF BALL AND RUBBER THREAD THEREFORE

FIELD OF THE INVENTION

The present invention relates to thread rubber for golf balls and to a thread wound golf ball using thread rubber. More particularly, the present invention relates to thread rubber for golf balls, which has good aging resistance and rebound characteristics, and to a thread wound golf ball which uses the thread rubber.

BACKGROUND OF THE INVENTION

Thread wound golf balls are generally used by many golfers, especially high level golfers, because the balls have excellent shot feel, good controllability and good rebound characteristics. The thread wound golf ball is composed of a center, a thread rubber layer formed on the center and a cover formed on the thread rubber layer, and the thread rubber layer is formed by winding thread rubber around the center at an elongation of about 800 to 1000% and imparts rebound characteristics and suitable compression strength (compression) to the resulting golf balls.

The thread rubber is conventionally formed from a blend of a high-cis polyisoprene rubber, such as natural rubber, and a synthetic low-cis polyisoprene rubber, because the low-cis polyisoprene rubber gives high rebound characteristics and the high-cis polyisoprene rubber gives high strength and compression stability to temperature. Although the compression is gradually reduced at a temperature of more than room temperature, the high-cis polyisoprene effectively inhibits the reduction.

As the content of the low-cis polyisoprene rubber is increased, the thread rubber increases in its rebound characteristics, but its strength and compression stability is reduced and are not suitable for practical use. It is therefore difficult to keep the balance between rebound characteristics and strength or compression stability to temperature in thread rubber for golf balls.

SUMMARY OF THE INVENTION

The present invention was made to satisfy the above desire and thus provides thread rubber for golf balls characterized in that a retention of tensile strength after aging for 7 days at 70° C. is not less than 70%; the hysteresis loss at a 100 Kg/cm$^2$ constant tensile stress not more than 50% and the elongation at a 100 Kg/cm$^2$ constant stress elongation is within the range of 900 to 1400%.

The present invention also provides a thread wound golf ball per se, in which a thread rubber layer is formed from the above-described thread rubber.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
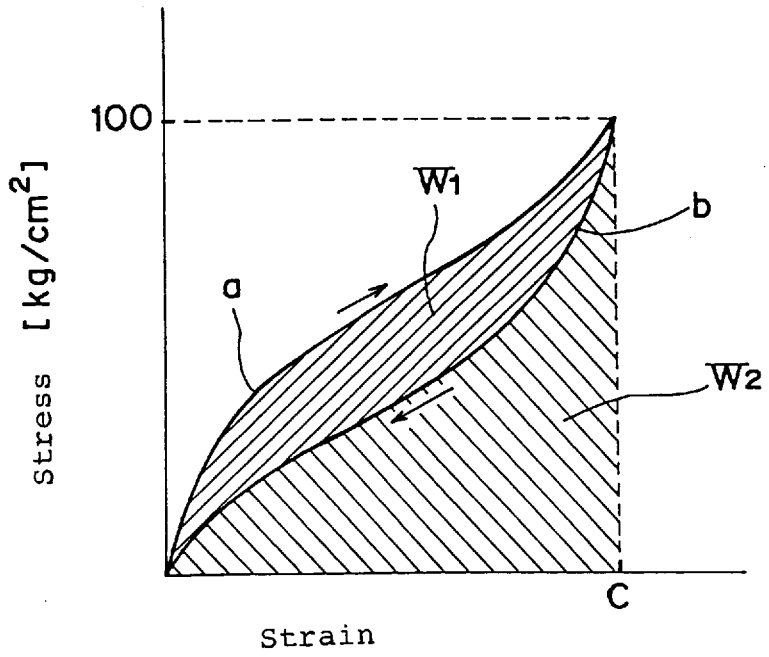
FIG. 1 shows a stress-strain hysteresis curve.

The retention of tensile strength, hysteresis loss and elongation are determined by the following method. A sample of thread rubber having a width of 1.6 mm and a thickness of 0.5 mm and a suitable length is equipped with a tensile strength tester to adjust its length to be tested to 22 mm and to draw the thread at a drawing rate of 500 mm/min. A retention of tensile strength is the value of the tensile strength after aging 7 days at 70° C. divided by the tensile strength before aging, times 100, to express it as a percentage. The hysteresis loss is determined from FIG. 1 which shows a hysteresis curve of stress-strain when a sample of the thread rubber is stretched at a tensile drawing rate of 500 mm/min at a 100 Kg/cm$^2$ constant stress by a tensile strength tester (Curve a in FIG. 1) and then restored to its original state (Curve b in FIG. 1). The hysteresis loss is the value of energy loss ($W_1$) divided by the energy ($W_1+W_2$) and is indicated as a unit of percentage.

$$\text{Hysteresis loss } (\%)=W_1/(W_1+W_2)\times 100$$

The elongation is the strain amount at 100 Kg/cm$^2$ tensile force, that is, point (c), and is determined from the following equation in terms of percentage.

$$\text{Elongation } (\%)=[(\text{stretched length/original length})-1]\times 100$$

The thread rubber of the present invention has a hysteresis loss of not more than 50%, preferably not more than 45% and preferably not less than 10%, more preferably not less than 38%. The thread rubber also has an elongation of 900 to 1,400%, preferably 950 to 1,300%, more preferably 1,000 to 1,150%. If the hysteresis loss is more than 50% or the elongation is less than 900%, the thread rubber does not have sufficient rebound characteristics. If the elongation is more than 1400%, it is difficult to wind the thread rubber on the center and also it reduces compression, thus resulting in poor rebound characteristics. If the hysteresis loss is less than 10%, the thread rubber is usable for a golf ball, but tends to exhibit reduced compression, thus resulting in poor rebound characteristics.

The thread rubber of the present invention also has a retention of tensile strength of not less than 70% after aging 7 day at 70° C. This feature governs compression stability of the resulting golf ball. If the retention is less than 70%, the compression of the golf balls would be reduced and would not be suitable for practical use.

The thread rubber of the present invention can be of any type as long as the above three features are met, but typical rubber composition and method for production are explained hereinafter.

The thread rubber may be obtained by vulcanizing a rubber composition which generally contains a rubber component and a vulcanizing agent.

The rubber component can generally be a polyisoprene rubber which is drawn and crystallized to form a thread rubber layer having high hardness. The rubber component may also include unsaturated rubber, such as polybutadiene rubber, styrene-butadiene rubber, ethylene-propylene rubber. The polyisoprene rubber is generally classified into high-cis polyisoprene rubber having a cis content of 98% or more, such as natural rubber, deproteinized natural rubber, synthetic high-cis polyisoprene rubber and the like; and low-cis polyisoprene rubber having cis content of less than 98%, such as Kariflex IR 309 having a cis content of about 92% and trans content of about 8% available from Shell Chemical Co. A mixture of the high-cis polyisoprene rubber and the low-cis polyisoprene rubber is generally employed considering the balance of strength and rebound characteristics, because the high-cis polyisoprene rubber is good for strength and the low-cis polyisoprene rubber is good for rebound characteristics.

As mentioned above, when the blend of the high-cis polyisoprene rubber and low-cis polyisoprene rubber is employed, rebound characteristics are enhanced while strength retention is adversely reduced. In order to improve the strength retention, it is proposed to formulate zinc oxide in the rubber composition. Zinc oxide is generally contained in an amount of 0.1 to 1.0 parts by weight based on 100 parts by weight of the rubber component. Amounts of less than 0.1 part by weight do not improve strength retention sufficiently and amounts of more than 1.0 part by weight reduces elongation and adversely affects the on rebound characteristics.

When the rubber component mainly contains the high-cis polyisoprene rubber, such as natural rubber or deproteined natural rubber, disulfides may preferably be added to the rubber composition to improve rebound characteristics. The disulfides include diphenyl disulfide or dinaphthyl disulfide, having one or more amino groups as substituents, which effectively enhances rebound characteristics and retention of the tensile strength.

Typical examples of the disulfide are bis(2-aminophenyl) disulfide, bis(4-aminophenyl) disulfide, bis(3-aminophenyl) disulfide, 2,2'-bis(1-aminonaphthyl) disulfide, 2,2'-bis(3-aminonaphthyl) disulfide, 2,2'-bis(4-aminonaphthyl) disulfide, 2,2'-bis(5-aminonaphthyl) disulfide, 2,2'-bis(6-aminonaphthyl) disulfide, 2,2'-bis(7-aminonaphthyl) disulfide, 2,2'-bis(8-aminonaphthyl) disulfide, 1,1'-bis(2-aminonaphthyl) disulfide, 1,1'-bis(3-aminonaphthyl) disulfide, 1,1'-bis(4-aminonaphthyl) disulfide, 1,2'-bis(5-aminonaphthyl) disulfide, 1,1'-bis(6-aminonaphthyl) disulfide, 1,1'bis(7-aminonaphthyl) disulfide, 1,1'-bis(8-aminonaphthyl) disulfide, 1,2'-diamino-1',2-dithiodinaphthalene, 2,3'-diamino-1,2'-dithiodinaphthalene and the like. Preferred are bis(2-aminophenyl) disulfide, 2,2'-bis(8-aminonaphthyl) disulfide, 1,1'-bis(2-aminonaphthyl) disulfide and 1,1'-bis(4-aminonaphthyl) disulfide.

In order to improve heat resistance of the thread rubber of the present invention, it is preferred that the sulfide is combined with zinc oxide.

The rubber employed in the present invention can either be a solid type rubber or a latex type rubber. The latex rubber contains rubber particles colloidally dispersed in an aqueous solution. Latex rubber is preferred for the present invention, because the resulting thread rubber has a higher strength.

The rubber composition may contain an antioxidant. Examples of the antioxidants are phenol compounds, such as 2,2'-methylenebis-(4-ethyl-6-t-butylphenol), 2,2'-methylenebis-(4-methyl-6-t-butylphenol), 2,6-di-t-butyl-4-methylphenol, 4,4'-thiobis-(6-t-butyl-3-methylphenol), tetrakis[methylene-3-(3',5'-di-t-butyl-4'-hydroxyphenyl) propionate]methane and the like. An amount of the antioxidant can be 0.1 to 5 parts by weight, based on 100 parts by weight of the rubber component.

The rubber component may further contain a vulcanizing agent, a vulcanization accelerator, a filler, oil and the like, in addition to the above mentioned components. The vulcanizing agent can generally be sulfur, a sulfur compound except the disulfide or a peroxide (e.g. dicumyl peroxide).

The vulcanization accelerator used in the present invention can be one which has been used for the vulcanization of the thread rubber for golf balls. Typical examples thereof are butyl aldehyde-aniline condensate (available from Ohuchi Shinko Chemical K.K. as Noccelar 8), diphenylguanidine (DPG), benzothiazole (M), dibenzothiadyl disulfide (DM), n-cyclohexyl-2-benzothiazole sulfenamide (CZ), n-t-butyl-2-benzothiazole sulfenamide (NS) and the like. The accelerator may be contained in the rubber composition in an amount of 0.1 to 5 parts by weight, based on 100 parts by weight of the rubber component.

Typical examples of the fillers are kaoline, clay, calcium carbonate and the like. The oil includes naphthenic oil, dioctyl adipate, dioctyl azelate, isooctyl tallate and the like. The amount of the filler may be within the range of 0 to 5 parts by weight, based on 100 parts by weight of the rubber component. The amount of the oil may be within the range of 0 to 10 parts by weight, based on 100 parts by weight of the rubber component.

The thread rubber may be prepared by mixing the above mentioned components in a mixer (e.g. a kneader or a Banbury mixer) and then extruding it in the form of a sheet having a thickness of about 0.5 mm, followed by vulcanizing at a temperature of 100° to 200° C. for 15 to 240 minutes. The resulting vulcanized sheet is cut into threads having a width of 1 to 2 mm.

Figure 2:
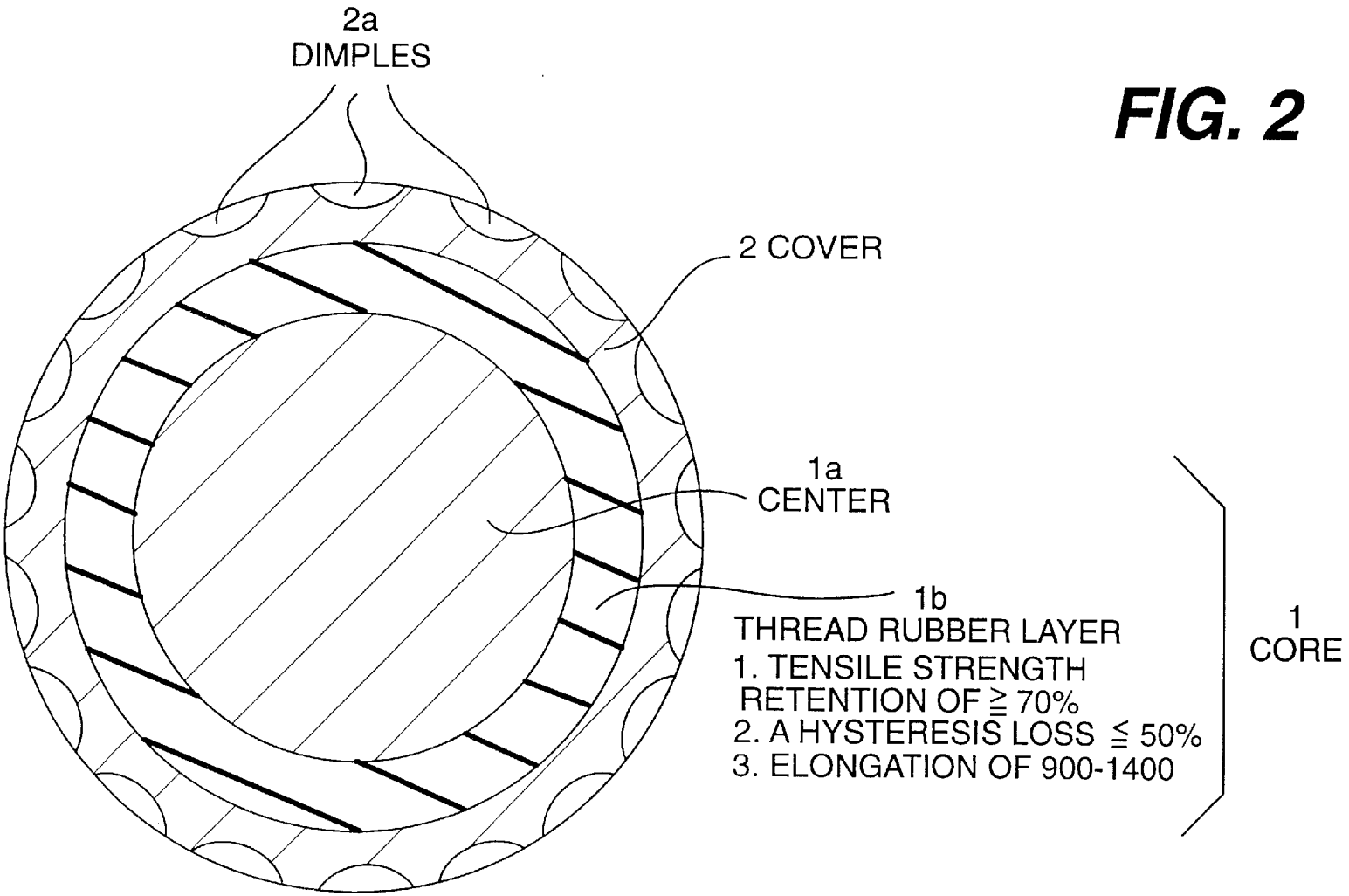
FIG. 2 shows a golf ball containing a core having a center portion and a thread rubber larger formed on the core and a cover surrounding the thread rubber layer.

The thread wound golf ball of FIG. 2 can be produced using the above obtained thread rubber. The thread rubber layer 1*b* is wound on a center 1*a* to form a thread wound core 1. A cover 2 containing dimples 2*a* is formed on the thread wound core. The length of the thread rubber wound on the center is not limited, but can be within the range of 4 to 8 m. The center can be one which has used for thread wound golf balls, such as a solid center formed from a vulcanized rubber and a liquid center composed of a rubber bag and liquid encapsulated in the rubber bag. The rubber for the solid center is known to the art, and may contains butadiene rubber, filler, peroxide vulcanizing agent and the like. The liquid used for the liquid center may be water, or an aqueous paste containing filler. The thread wound core is then covered with a cover material selected from the group consisting of of an ionomer resin and transpolyisoprene (balata). When forming the cover, many depressions called "dimples" are generally formed on the cover for controlling air resistance when flying. The golf ball having a dimpled cover is then coated with paint to finish for serving commercial sell.

EXAMPLES

The present invention will be illustrated by Examples which, however, are not to be construed as limiting the present invention to their details.

Examples 1 to 5 and Comparative Examples 1 to 4

(Preparation of latex compositions)

Nine kinds of latex compositions were prepared from the ingredients shown in Tables 1 and 2 by mixing. In Tables 1 and 2, the numbers show parts by weight and in case of latex, it shows an amount of rubber content. The other components are shown in an amount of effective component. Details of the formulated chemicals are shown after Table 2.

TABLE 1

| | Example number | | | | |
|---|---|---|---|---|---|
| | 1 | 2 | 3 | 4 | 5 |
| Rubber component (a) | | | | | |
| IOTEX C-60 (60%)*1 | 40 | 30 | — | — | 100 |
| Deproteinized natural rubber latex (60%)*2 | — | — | 100 | 100 | — |
| Maxprene IR latex (65%)*3 | 60 | 70 | — | — | — |
| Vulcanization accelerator (emulsion; effective component 20%)*4 | 1.0 | 1.0 | 1.0 | 1.0 | 1.0 |
| Sulfur (dispersion; effective component 50%) | 2.0 | 2.0 | 2.5 | 2.7 | 2.5 |
| Antioxidant (dispersion: effective component 40%)*5 | 1.0 | 1.0 | 1.0 | 1.0 | 1.0 |
| Zinc oxide (dispersion: effective component 50%) | 0.5 | 0.5 | 0.5 | — | 0.5 |
| Bis(2-aminophenyl) disulfide (dispersion, effective component 33.3%)*6 | — | — | 2.0 | 2.0 | 3.0 |

TABLE 2

| | Comparative Example number | | | |
|---|---|---|---|---|
| | 1 | 2 | 3 | 4 |
| Rubber component (a) | | | | |
| IOTEX C-60(60%)*1 | 40 | 30 | 100 | — |
| Deproteinized natural rubber latex (60%)*2 | — | — | — | 100 |
| Maxprene IR latex (65%)*3 | 60 | 70 | — | — |
| Vulcanization accelerator (emulsion; effective component 20%)*4 | 1.0 | 1.0 | 1.0 | 1.0 |
| Sulfur (dispersion; effective component 50%) | 2.5 | 2.5 | 2.5 | 2.5 |
| Antioxidant (dispersion: effective component 40%)*5 | 1.0 | 1.0 | 1.0 | 1.0 |
| Zinc oxide (dispersion: effective component 50%) | — | — | — | — |
| Bis(2-aminophenyl) disulfide (dispersion, effective component 33.3%)*6 | — | — | — | — |

*1IOTEX C-60: High ammonia preserved natural rubber latex available from Malaysia IOI.
*2Deproteinized ammonia preserved natural rubber latex having a non-rubber content of less than 0.1% by weight.
*3Maxprene IR: Low cis-polyisoprene rubber latex available from Sumitomo Seika Chemicals Co., Ltd.
*4Butyl aldehyde-aniline condensate available from Ohuchi Shinko Kagaku K.K. as Noccelar 8.
*5 2,2"-Methylenebis-(4-ethyl-6-t-butylphenol) available from Yoshitomi Pharmaceutical Industries, Ltd.
*6An organic disulfide compound having a melting point of 93° C.

(Preparation of thread rubber)

Each latex composition according to the ingredients shown in Examples 1–5 and Comparative Examples 1–4 was solidified on an endless belt on which a solidifying solution of an aqueous calcium chloride was coated, to form a sheet. The sheet was dried and then rolled up on a drum which was vulcanized at 135° C. for 2 hours in a vulcanizer to form a vulcanized rubber sheet having width 250 mm×thickness 0.5 mm×length 50 m. It was then cut into width 1.6 mm to form thread rubber. The resulting thread rubber was subjected to an evaluation of hysteresis loss (%), elongation at 100 Kg/cm$^2$ tensile force and retention of tensile strength, and their results are shown in Tables 3 to 4.

(Preparation of thread wound golf balls)

The thread rubber obtained above was wound on a solid center of polybutadiene vulcanized rubber having a diameter of 28.3 mm, a JIS-A hardness of 75 and a weight of 20.5 g in a drawn condition to form a thread wound core having a diameter of about 39.9 mm. It was then covered with an ionomer cover containing ionomer resin and titanium oxide, on which painting and marking were provided to form a thread wound golf ball having a diameter of about 42.7 mm. The ionomer resin was a mixture of Hi-milan 1605 and Hi-milan 1706 in 40/60 weight ratio, both Hi-milans being available from Mitsui Du Pont Polychemical Co., Ltd. and the resulting golf ball had a ball weight of 45.4 to 45.6 g. The resulting thread wound golf ball was subjected to an evaluation of initial velocity for rebound characteristics and compression stability. The results are shown in Tables 3 to 4.

(Method of test)

(1) Initial velocity of balls determined by the R & A initial velocity measuring method.

(2) Compression stability of balls

The golf balls obtained were kept in an oven at 70° C. for 72 hours, after which compressions of the aged balls were measured according to the PGA method. Before the aging test, compressions were determined by the PGA method and the difference between before and after the aging test is shown as test data. In data, the minus (−) expression shows that the compression reduced after the aging test.

Results of the tests

TABLE 3

| | Example number | | | | |
|---|---|---|---|---|---|
| | 1 | 2 | 3 | 4 | 5 |
| Hysteresis loss (%) | 45 | 40 | 41 | 38 | 43 |
| Elongation (%) | 1000 | 1100 | 1100 | 1150 | 1050 |
| Retention of tensile strength | 90 | 85 | 85 | 80 | 85 |
| Initial velocity (feet/sec) | 252.3 | 252.8 | 252.7 | 253.0 | 252.5 |
| Compression before aging test | 80 | 80 | 80 | 80 | 80 |
| Difference of compression between before and after the aging test | −9 | −10 | −10 | −11 | −10 |

TABLE 4

| | Comparative Example number | | | |
|---|---|---|---|---|
| | 1 | 2 | 3 | 4 |
| Hysteresis loss (%) | 43 | 38 | 60 | 55 |
| Elongation (%) | 1050 | 1150 | 800 | 850 |
| Retention of tensile strength | 50 | 45 | 85 | 80 |
| Initial velocity (feet/sec) | 252.5 | 253.0 | 250.0 | 250.5 |
| Compression before aging test | 80 | 80 | 80 | 80 |
| Difference of compression between before and after the aging test | −19 | −20 | −10 | −11 |

As is apparent from the above results, the thread rubbers of Examples 1–5 are good in rebound characteristics and compression stability in comparison with the thread rubbers of Comparative Examples 1–4, and satisfy the required performance of golf balls.

The thread rubber of the present invention controls retention of tensile strength, hysteresis loss and elongation to specified ranges, whereby the resulting golf balls are excellent in rebound characteristics and compression stability.

What is claimed is:

1. A thread rubber for golf balls having a retention of tensile strength after aging 7 days at 70° C. of not less that 70%, a hysteresis loss at a 100 $Kg/cm^2$ constant stress tensile of not more than 50% and an elongation at a 100 $Kg/cm^2$ constant stress elongation within the range of 900 to 1400%.

2. The thread rubber for golf balls according to claim 1 obtained from a rubber composition comprising a rubber component made of a mixture of high-cis polyisoprene rubber and low-cis polyisoprene rubber, a vulcanizing agent, zinc oxide and an antioxidant.

3. The thread rubber for golf balls of claim 2 wherein the rubber composition contains zinc oxide in an amount of 0.1 to 1.0 parts by weight based on 100 parts by weight of the rubber component.

4. The thread rubber for golf balls according to claim 1 obtained from a rubber composition comprising a rubber component made of high-cis polyisoprene rubber, a vulcanizing agent, an antioxidant and a diphenyl or dinapthyl disulfide having one or more amino groups as substituents.

5. The thread rubber for golf balls of claim 4 wherein the rubber composition contains zinc oxide in an amount of 0.1 to 1.0 parts by weight based on 100 parts by weight of the rubber component.

6. A golf ball having good aging resistance and rebound characteristics which comprises a center, a thread rubber layer formed on the center and a cover formed on the thread rubber layer, wherein the thread rubber layer is formed from thread rubber having a retention of tensile strength after aging 7 days at 70° C. of not less that 70%, a hysteresis loss at a 100 $Kg/cm^2$ constant stress tensile of not more than 50% and an elongation at a 100 $Kg/cm^2$ constant stress elongation within the range of 900 to 1400%.

* * * * *